US005844163A

United States Patent [19]

Lindskog

[11] Patent Number: 5,844,163

[45] Date of Patent: Dec. 1, 1998

[54] LOADING SYSTEM

[75] Inventor: Lars-Olov Lindskog, Karlskoga, Sweden

[73] Assignee: Bofors AB, Karlskaga, Sweden

[21] Appl. No.: 793,757

[22] PCT Filed: Sep. 6, 1995

[86] PCT No.: PCT/SE95/00994

§ 371 Date: May 28, 1997

§ 102(e) Date: May 28, 1997

[87] PCT Pub. No.: WO96/07865

PCT Pub. Date: Mar. 14, 1996

[30] Foreign Application Priority Data

Sep. 7, 1994 [SE] Sweden ..... 9402976

[51] Int. Cl.[6] ..... F41A 9/42; F41A 9/76

[52] U.S. Cl. ..... 89/46; 89/47

[58] Field of Search ..... 89/45, 46, 47, 89/33.05, 33.04

[56] References Cited

U.S. PATENT DOCUMENTS

| | | | |
|---|---|---|---|
| 1,310,890 | 7/1919 | Schneider | 89/47 |
| 4,706,544 | 11/1987 | Zielinski et al. | 89/46 |
| 4,949,640 | 8/1990 | Reinelt | 206/3 |
| 5,111,730 | 5/1992 | Gradner | 89/45 |
| 5,170,006 | 12/1992 | Maher et al. . | |
| 5,289,754 | 3/1994 | Elspass | 89/46 |
| 5,458,044 | 10/1995 | Delbos | 89/45 |

FOREIGN PATENT DOCUMENTS

| | | | |
|---|---|---|---|
| 7000615 | 6/1978 | Germany . | |
| 3642920 | 6/1988 | Germany | 89/46 |
| 3294793 | 12/1991 | Japan | 89/47 |

*Primary Examiner*—Stephen M. Johnson
*Attorney, Agent, or Firm*—Pollock, Vande Sande & Priddy

[57] ABSTRACT

The present invention relates to a method and device for the preparation of propellant charges for automatic loading into artillery guns of the type which are loaded with propellant in the form of propellant modules usually designed charge modules, which have uniform section and combustible mainly stiff casings. The invention is based on the utilization of a special type of magazine in which sets of charge modules which correspond to the maximum charge for the artillery gun are successively fed to a module feeding device opening where the quantity of charge modules required for the next projectile is fed from the magazine to a loading pendulum which is swung into position at the module feeding device opening. Loading pendulum is fitted with devices for arranging the charge modules in a straight column above or following each other and for compressing the charge modules longitudinally into a unified propellant charge which can subsequently be rammed automatically by a conventional flick rammer. The charge modules which are superfluous following each charge loading operation are fed back to the magazine.

10 Claims, 5 Drawing Sheets

LOADING SYSTEM

FIELD OF THE INVENTION

The present invention relates to a method and a device for the preparation of propellant charges for automatic loading into artillery guns of the type which are loaded for different firing ranges with so-called modular charges. The charges consist of a predetermined number of propellant units in the form of combustible propellant modules of uniform section with stiff outer casings. It is a requirement for one type of these propellant units or modular charges that they are so designed that it is possible to connect them to larger charges without any special preparation.

BACKGROUND OF THE INVENTION

Propellant modules of modular charge type have many advantages over the conventional cartridged ammunition and the types which include soft, so-called bag charges. The drawbacks of the time-consuming cartridge handling procedures and the high cost and high weight of the cartridges are avoided, and one obtains propellant charges which are considerably easier to ram automatically than the soft charge bags. A further advantage is that the modular charges are comparatively easy to adapt for the different firing ranges and/or projectiles merely by choosing one or several of the charges.

It is not easy, however, to design a complete fully-automatic loading system even for modular charges as such complete systems must include the means for selection of the required firing range using the appropriate quantity of charge modules which can be of varying length, and also the means for combining the selected number of charge modules into one unit. In cases where the propellant modules are of the interconnecting type, the actual connection of the said modules must also be carried out. These operations make it possible to automatically load the propellant charges with the high loading velocities now required by modern artillery systems.

As referred to in the first paragraph, the combustible modular charges in at least one for the configurations are fitted with the means of interconnection in the form of a front protruding heel of somewhat smaller diameter than the charge itself and at the rear, a protruding ring-formed flange with an inner diameter which is adapted to the heel on another propellant module of the same type. This design allows several modular charges to be pressed together to form a more or less stiff unit which is well suited to be rammed by, for example a modern flick rammer. This type of rammer will probably be increasingly used since it is regarded as the best for increasing the rate of fire of barrel artillery systems.

We have, however, now discovered that not only the interconnectable modular charges can be used in the present invention, but also the charges which have no interconnection function and have only unconnected propellant modules which together form a composite charge and which, following preparation can be automatically rammed by a flick rammer. That this is possible seems to be a direct consequence of the fact that the propellant units, despite being comprised of several relatively independent modules, are sufficiently combined and aligned by the present invention when delivered to the flick rammer.

The principle features of the actual propellant modules or modular charges referred to in this context are described in U.S. Pat. No. 4,949,640 and DE-A-7 000 615.4.

To connect manually the required numbers of modular charges and then carry out automatic rang as has been the case hereto does not constitute a good solution to the problem as in order to meet the requirement for high rate of fire, it is necessary to increase the gun crew by a number of loaders whose sole task is to prepare the charges. This leads to the problem of providing the increased personnel and consequently larger area with at least adequate protection against fragments.

The requirement for fully-automatic loading systems even for large caliber and medium caliber artillery has recently been accentuated due to the improvement in methods of locating enemy guns in operation. Modern artillery tactics now strive to have a number of shells on the way to the target simultaneously before the first shell has reached the target, at the same time as it is recognized that one shall preferably change firing position immediately after the final shell in the salvo has been fired. This obviously places very high demands on the rates of fire. Further requirements result from the fact that the simplest manner of having several rounds in the air on the way to the same target relies on the rounds being fired with different trajectories and different propellant charges. Besides the requirement for high firing rates it is also necessary for the right amounts and types of propellant charges to be readily available.

SUMMARY OF THE INVENTION

The object of the present invention is to propose a method and a device for the preparation of propellant charges adapted for automatic ramming with charge weights determined immediately prior to ramming for such artillery guns that are loaded with a number of propellant modules of the type described above with stiff, combustible cartridges and selected according to the projectile types, projectile trajectories and consequent elevations. The present invention provides for all operations, from the selection of the number of propellant modules, to be carried out automatically without the gun crew being required to handle the shells or propellant modules manually. It will be possible for the gun crew to carry out all operations from a position which is provided at least with fragment protection and mainly from the front section of the gun vehicle. The invention, however, allows complete operation of the gun by remote control.

A further advantage provided by the present invention is that the gun is rendered completely independent for at least shorter periods as the invention provides sufficient gun service in the form of its own fire control system and a complete loading system together with a short term supply of rounds and propellant charges. Gun flexibility is thereby greatly increased as once in firing position, the gun can perform at least shorter missions without the need of a service vehicle in the immediate vicinity. This obviously results in less time being required before the gun is ready to fire and a reduced risk of detection and thereby increased protection against enemy fire.

The artillery system which results from the improvements provided by the present invention has many familiar components such as the gun itself, the loading system with rammer, the rounds and propellant charges, the fire control system etc. However, as the entire magazine system and loading pendulum and the associated sub-systems for preparing the propellant charges are completely new, the entire artillery system must also be regarded as new especially as some novel improvements have been achieved.

The idea behind the invention is that there shall always be a number of charge modules available in the module feeding device opening of the on-gun automatic magazine for apportioning the charge modules. The number of modules shall correspond to the maximum charge for the gun. Each round is prepared by feeding out the calculated number of charge modules from the magazine to a loading pendulum or equivalent where the modules are arranged in a straight column by the sides of the pendulum pressing inwards and forcing the modules into alignment. A protrudable device in the longitudinal direction of the pendulum is then activated so that the charge modules are compressed against a counter support and form a tightly packed unit. If the modules are of the connectable type, a simultaneous connection operation between the heels and ring-form flanges of the various modules is carried out so that the individual modules form a single propellant charge. Irrespective of the type of charge module, the propellant charge obtained shall now be transferred to the rammer for automatic ramming into the gun immediately following the ramming of the selected round. For the method to function well, the magazine must always provide the required number of propellant charges and the loading pendulum must arrange the modules in a sufficiently accurate column to enable the modules to be compressed to form the units required for the continuation of the process.

The magazine in accordance with the invention, has a number of propellant compartments on an endless conveyor, each holding one single or alternatively, several ready-connected propellant charges. According to the invention, the magazine includes not only a row of such compartments but several rows arranged alongside or preferably above each other. A complete collection of such compartments, that is one from each row, arranged above or besides each other forms a set of compartments. The number of filled compartments in a set corresponds to the gun's maximum charge. In the basic embodiment, the positions of the various compartments are the same in each set of compartments and each set of compartments is identical. The sets of compartments are fed as fixed units by one or several coordinated conveyors up to the magazine module feeding device opening. In the preparation of propellant charges for each round, the number of modules required are pushed out of the compartments by devices designed for this purpose and are transferred to the loading pendulum. The propellant charges which are not used are moved with the set of departments to the magazine return and filling side which can advantageously be so designed that it is possible to open completely in order to facilitate the refilling of empty compartments.

Another possibility is to allow each row of compartments to be maneuvered by its own conveyor system so that the new compartments are delivered to the set of compartments only to the extent that the previous compartments have been emptied.

It should be clear from the above that there is an ejector at the magazine module feeding device opening for each compartment placed at the device. The ejectors are activated as soon as the loading pendulum is swung in against the magazine module feeding device opening and its sides are sufficiently opened to receive the propellant modules. Prior to this, the ejectors must have received the signal regarding the propellant charge modules to be included in the charge in question.

The loading pendulum is free to swing and possibly extendible and suspended in the magazine but such detailed design is described only in the enclosed drawings.

The figures have been drawn on different scales so that each is as clear as possible within the available space.

DETAILED DESCRIPTION OF THE PREFERRED EMBODIMENT(S)

Figure 1:
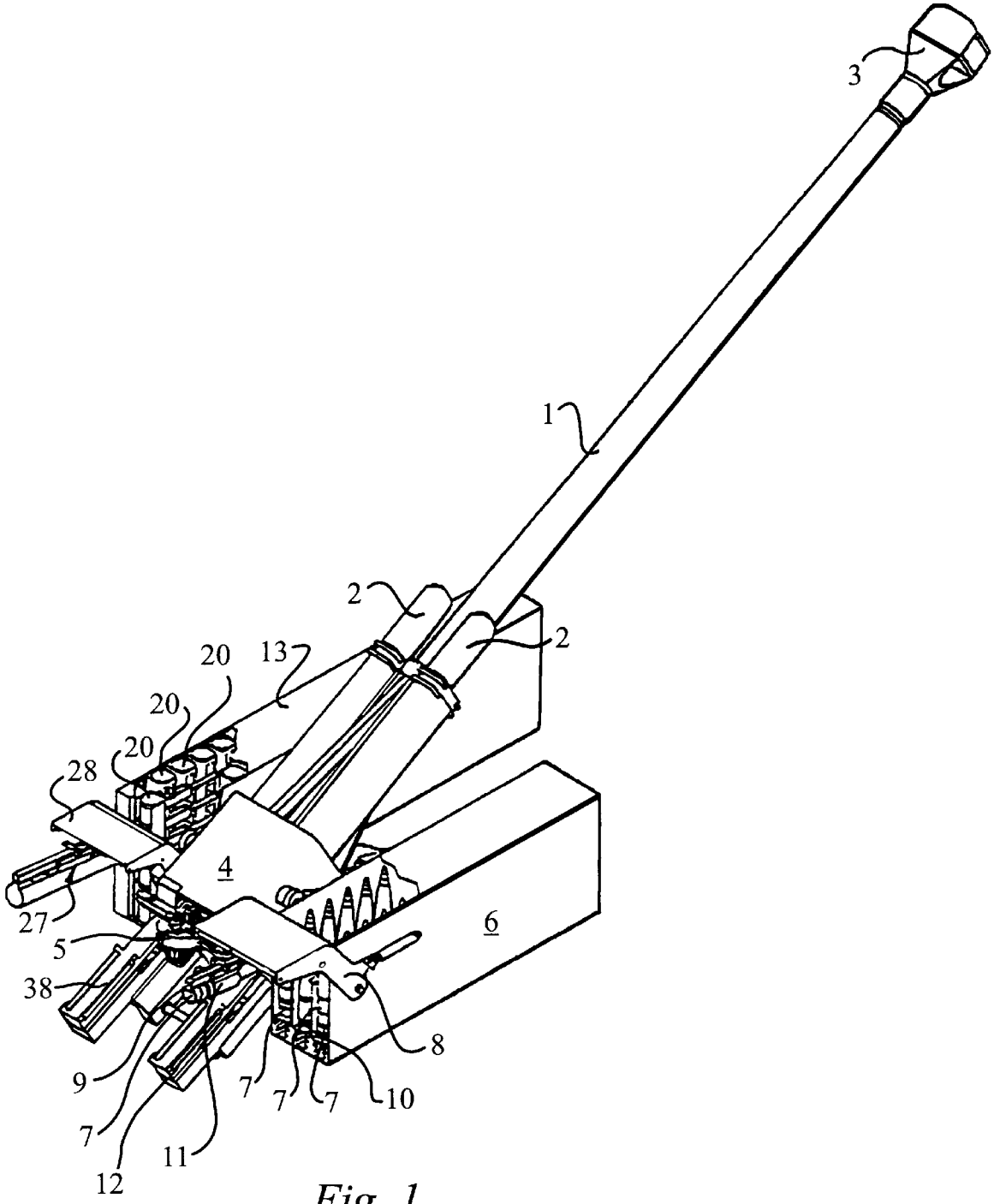
FIG. 1 shows a partly sectioned angled projection of an artillery gun designed in accordance with the invention but for the purpose of clarity without the mounting.
Figure 2:
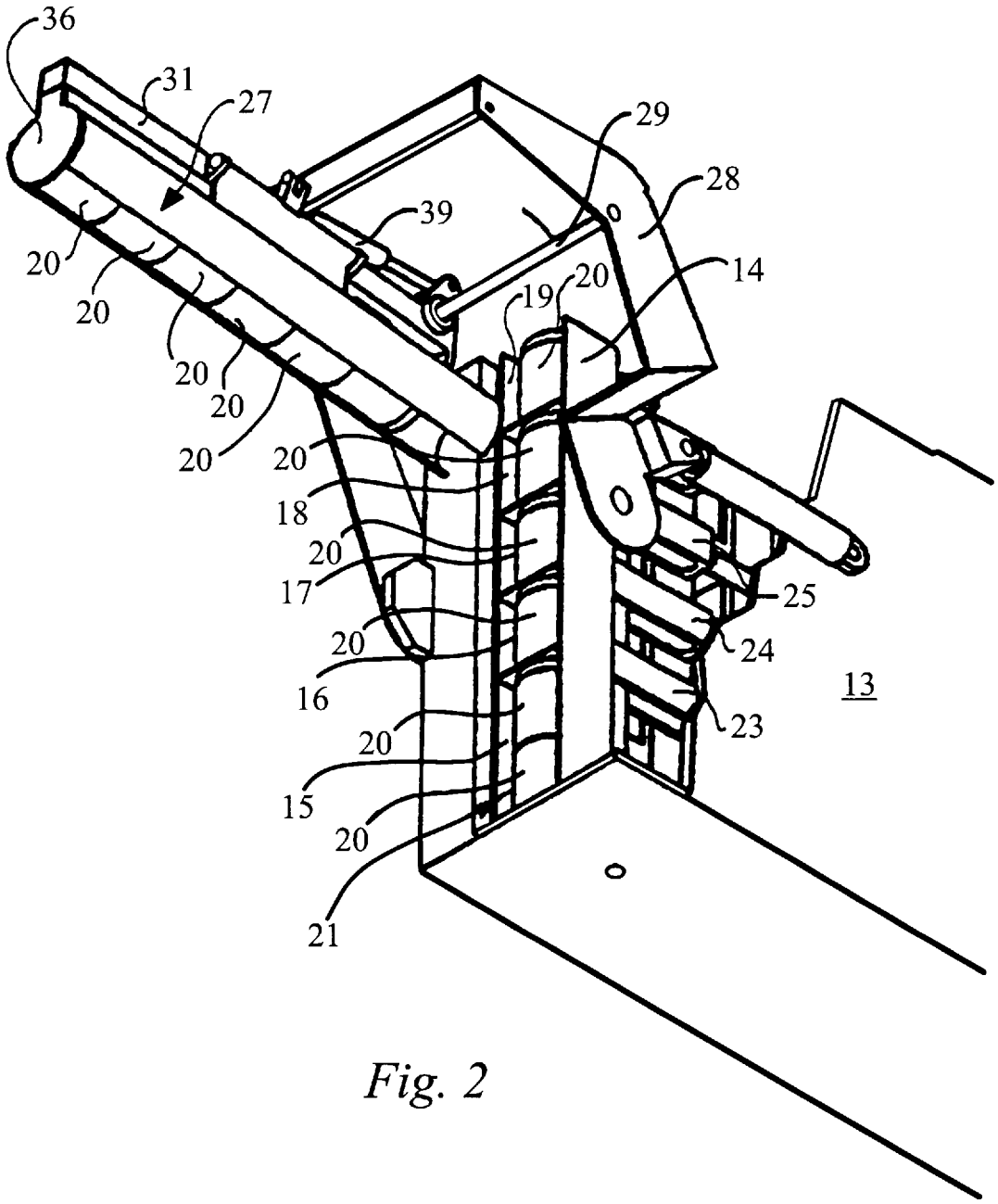
FIGS. 2 and 3 show two different partly sectioned angled projections of the magazine feeding end.
Figure 3:
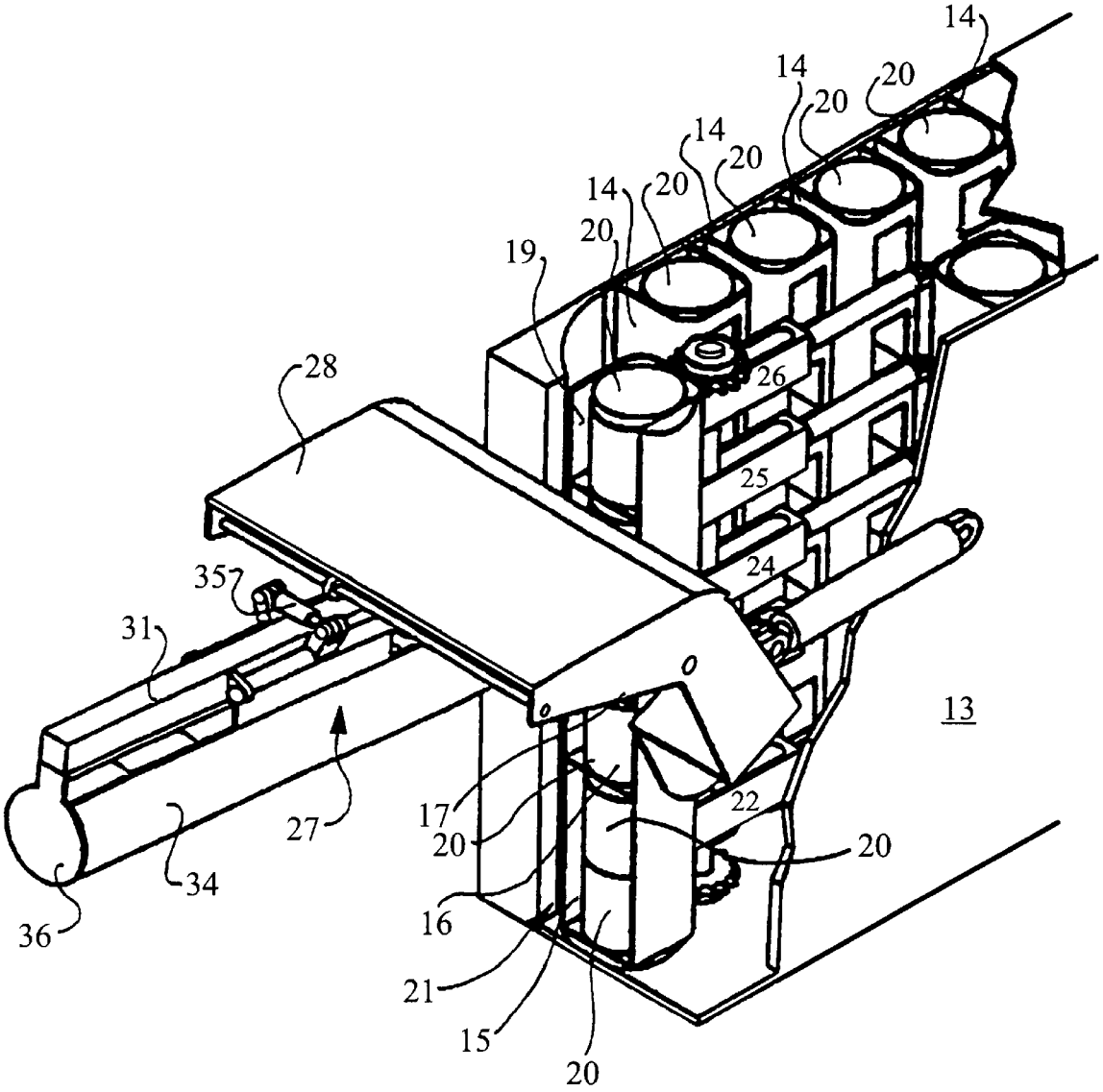
Figure 4:
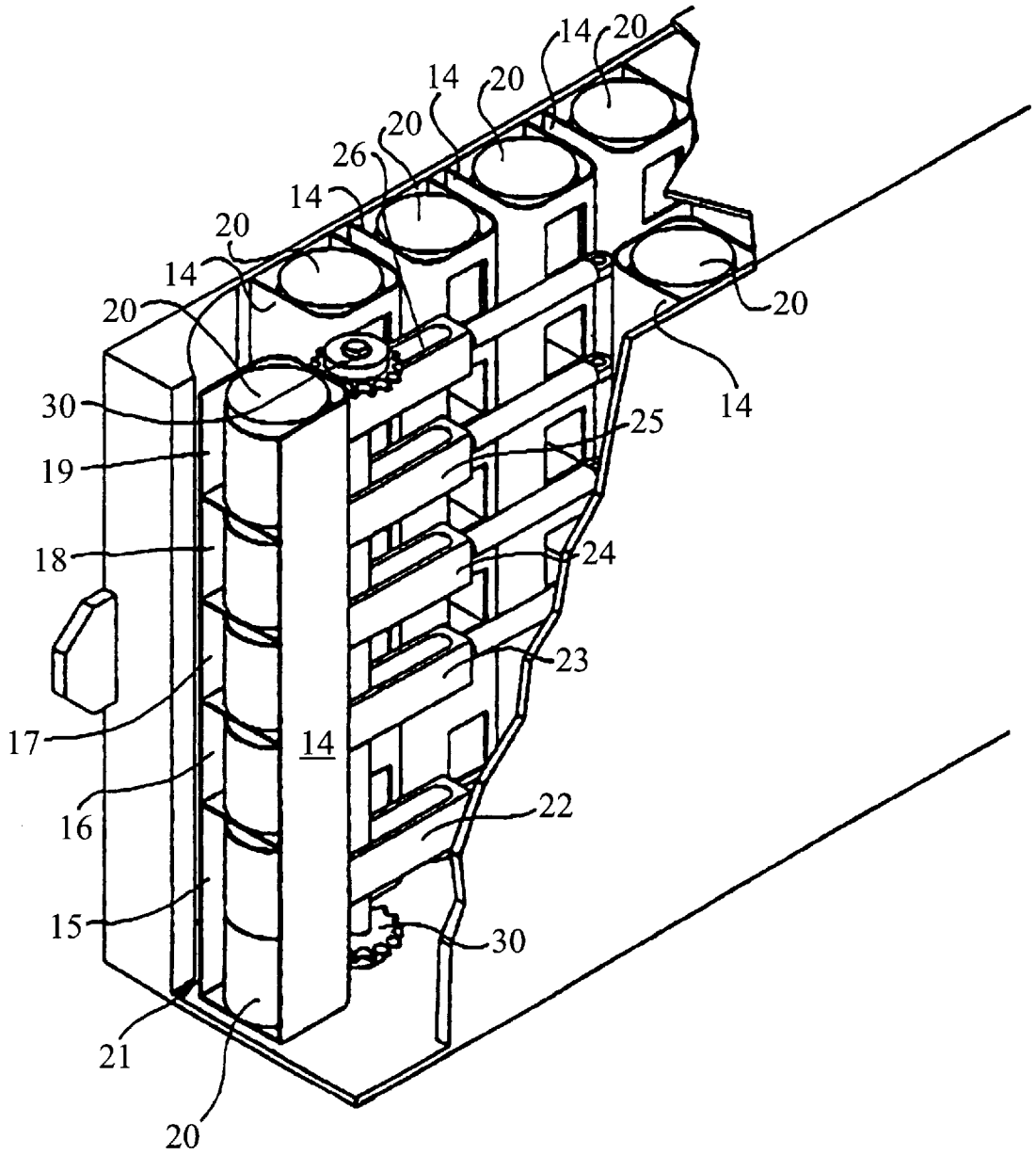
FIG. 4 is similar to FIG. 2 but without the loading pendulum.
Figure 5D:
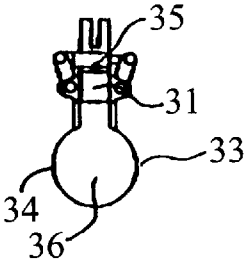
FIG. 5 *a–d* illustrates loading pendulum only in four different projections.
Figure 5B:
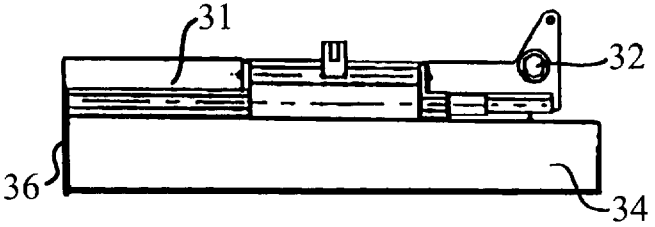
Figure 5C:
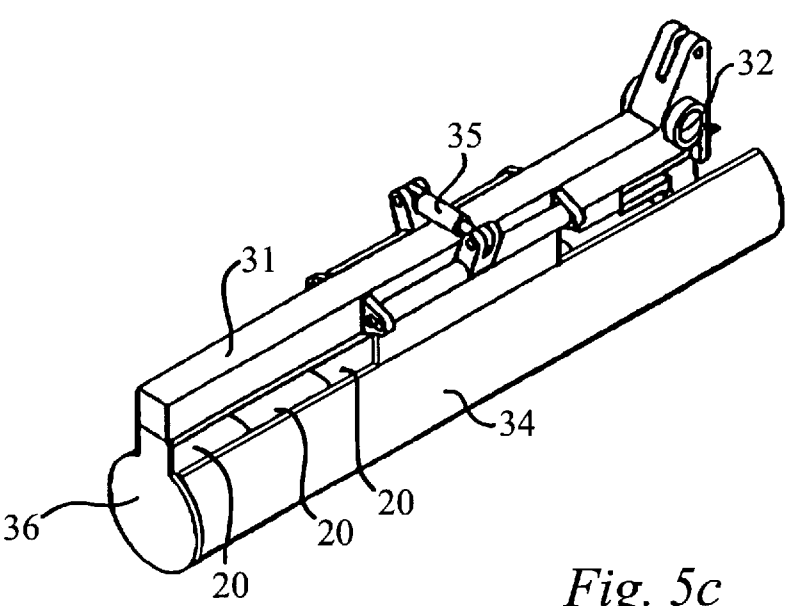
Figure 5A:
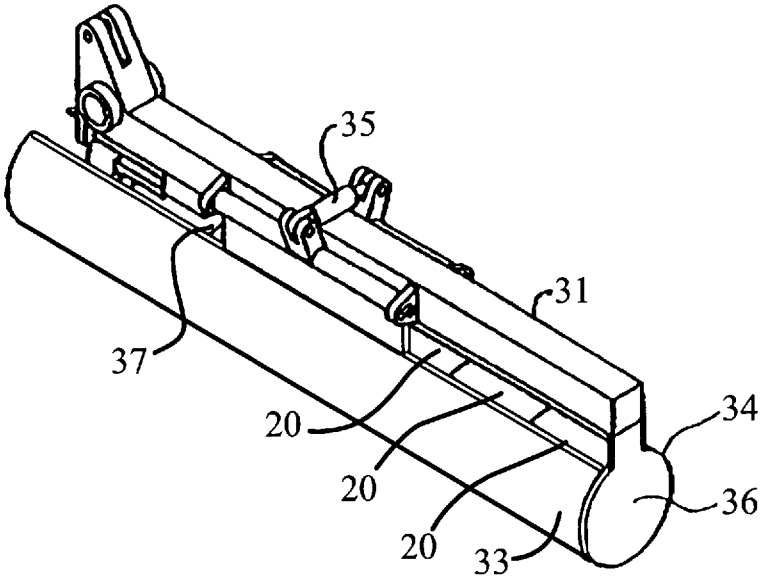

The artillery gun shown in FIG. 1 includes the barrel 1 with recoil buffers and recuperator 2, muzzle brake 3, gun cradle 4 and a conventional mechanism 5 which is shown in an open position in the figure.

The figure also shows some of the most important components on the gun which are not discussed elsewhere in this text as they are not affected by the invention. These include the shell magazine 6 which holds the three rows of shells 7 of the three main types which can be fed out individually. There is a pivotable cradle 8 beside the shell magazine 6. A shell pendulum 9, which is pivotable and protrudable, is suspended in the cradle 8. The pendulum can be swung from the horizontal position shown in FIG. 1 to a vertical position adjacent to the shell magazine 6 feeding device opening 10.

The pendulum can also be set in position directly in front of the shell required for loading into the gun. Using the shell pendulum 9 grabs 11, the shell in question is lifted from its location in the magazine to the horizontal position shown in FIG. 1. The pendulum is then moved transversely to a position in line with and above the rammer 12 upon which the shell pendulum cradle 8 (which is journalled in the gun trunnion center) with the shell pendulum 9 swings to a position corresponding to the gun elevation and the shell can be directly transferred to the flick rammer 12. This also follows the gun elevation and the shell can be rammed when the rammer has swung into alignment with the barrel 1.

FIG. 1 shows the propellant magazine 13 which is the result of the present invention but FIGS. 2–5*d* show the magazine with subsidiary systems in greater detail on a larger scale. An automatically protrudable conveyor (see for example FIG. 3) consisting of several hinged vertical sets of compartments 14 runs in the propellant charge magazine 13. These are shown as chutes open on one side in the drawings. Each of these sets of compartments 14 or chutes holds a number of compartments 15–19 each originally holding one or, in the case of compartment 15, two propellant modules 20. The number of propellant modules in each compartment can of course vary between one and several depending on the gun to be loaded and the size of the propellant modules. The compartment set 14 is designed to be fed by the conveyor to a vertical feeding device opening 21 in the magazine. In this position all the charge modules 20 in the various compartments in the set can be influenced by the ejectors 22–26 designed for this purpose. The intention is that the feeding device opening 21 be fed with new compartment sets with all compartments 15–19 filled with charge modules 20 to the extent required. Ejectors 22–26 adapted for each individual shell are moved so as to be in line with the feeding device opening 21 swung down by he loading pendulum 27 which has firstly a swinging function 39 (which is not seen in FIG. 1 but visible in FIG. 2) which is used for swinging down the pendulum in line with feeding device opening 21 and secondly, a swinging function in the form of the cradle 28 journalled in the gun trunnion center. From here it can be swung down to an angle which is adjusted to gun elevation in order, in the same manner as for the shell, to be in line with the adjusted angle of its own loading pendulum 38 for direct transfer of the modular charge to the propellant charge rammer which itself is at an angle adjusted in accordance with gun elevation. The loading pendulum is fixed in cradle 28 so that it can be moved to the side along guidance beam 29 shown in FIG. 2. Its transverse position can also be adjusted relative to the charge module rammer 38.

When the required amount of charge modules 20 are transferred to loading pendulum 27, the conveyor is advanced by cog wheel 30 being turned one step and the charge modules 20 not included in the previous set of compartments are returned to the system. At the same time, a complete set of charge modules corresponding to the maximum charge for the gun becomes available in the feeding device opening 21 for the next loading operation. See FIG. 5*a–d* which shows the design of loading pendulum 27 for a more detailed description of the operations concerning the charge modules 20 which are transferred to loading pendulum 27.

The transfer of the predetermined quantity of charge modules 20 to loading pendulum 27 by ejection from their compartments 15–19 by ejectors 22–26 is carried out with loading pendulum 27 in swung down vertical position in line with the feeding device opening 21.

The loading pendulum operates around main beam 31 which has a journal 32 for guide beam 29 along which the pendulum can be moved. The loading pendulum also has long side walls 33,34 which are adapted to the external form of charge modules 20 and which are hinged-journalled and can be opened by a hydraulic piston 35 and a fixed counter support 36 arranged in the end of the loading pendulum to point downwards when the pendulum is swung down against the magazine feeding device opening. There is a moveable compacting heel 37 inside the loading pendulum but it is partly hidden in the drawing between the fixed counter support 36 and the opposite end.

Loading pendulum 27 now operates so that when it is first swung down vertically against module feeding device opening 21 and the pendulum long sides 33,34 are opened sufficiently for a charge modules 20 to be inserted, the correct number of charge modules 20 are moved over to the loading pendulum 27. As soon as this operation is completed, hydraulic piston 35 is activated and the loading pendulum long sides 33,34 are closed and the charge modules are compressed into a straight column. The hydraulic piston then activates compacting heel 37 so that it projects and presses the charge modules 20 together so that the heels and flanges engage and form a unified charge which is ready for ramming.

The loading pendulum is then swung up and to the side so as to be in line and above flick rammer 38 (shown in FIG. 1) upon which the loading pendulum cradle 28 (which is journalled in the gun trunnion center) swings together with the loading pendulum to a position corresponding to the gun elevation with the pendulum immediately above the flick rammer. The propellant charge is then inserted into the rammer when the loading pendulum sides are opened. The subsequent swinging of the flick rammer towards the barrel chamber and ramming of the propellant charge are conventional techniques which will not be dealt with further in this context.

All the figures show propellant modules (modular charges) of the connectable type. Function is, however, identical for comparable non-connectable charges with the same transfer to the loading pendulum, the same arrangement into a straight column by the sides of the loading pendulum compressing the charges, and the compacting heel pressing the charges together lengthways followed by their subsequent transfer to the rammer and ramming in the gun.

I hereby claim and desire to secure by Letters Patent the following:

1. A device for preparing for automatic loading of propellant charges for an artillery gun which are loaded with projectiles using a flick rammer, said propellant charges comprising combinable charge modules of uniform section and having combustible casings, said device comprising:

a feeding magazine;

a plurality of chutes in said feeding magazine, each of said chutes holding a set of charge modules corresponding to a maximum charge of said gun;

a feeding magazine feed opening for receiving a chute of charge modules to be ejected;

a conveyor in said feeding magazine and connected to said plurality of chutes for conveying a chute of charge modules to said magazine feed opening;

a set of ejectors for ejecting charge modules from a chute in said magazine feed opening, said set of ejectors comprising one ejector for ejecting each charge module in said chute; and a loading pendulum for transferring said set of charge modules ejected from said chute in said magazine feed opening to said artillery gun, said pendulum having a compacting heel for compacting said set of charge modules against an axial charge support of said pendulum.

2. The device according to claim 1 wherein said conveyor includes a moving conveyor belt fitted on cog wheels fixed at each end of said feeding magazine, said plurality of chutes being disposed along said conveyor belt.

3. The device according to claim 1 wherein each of said chutes comprises a number of spaces for charge modules, said spaces being placed in a vertical row in said chute and being separated by charge module support plates.

4. The device according to claim 1 wherein one vertical side of said feed magazine is openable for insertion of charge modules into empty compartments.

5. The device according to claim 1 wherein said set of ejectors are programmed to eject a selected number of charge modules beginning at the lowest level so that the charge modules form a column from the bottom and upwards in loading pendulum.

6. The device according to claim 1 wherein said loading pendulum is suspended in a manner which allows it to be moved in a pivotable cradle journalled in the feeding magazine, allowing the loading pendulum to be swung down vertically to a position opposite said feed opening and further, to be swung up horizontally and to all intermediate positions for the transfer of completed propellant charges to a rammer of the gun.

7. A method of preparing propellant charges for loading into an artillery gun, said propellant charges comprising combinable charge modules of uniform section and having combustible casings, said method comprising the steps of:

housing sets of charge modules within chutes in a feed magazine, each of said sets having a number of charge modules corresponding to a maximum charge of said gun;

conveying a chute of charge modules to a feed magazine feed opening via a conveyor;

ejecting each of said charge modules from said chute with a set of ejectors, said set of ejectors comprising one ejector for ejecting each charge module in said chute;

compacting said charge modules ejected from said chute in a loading pendulum; and transferring said charge modules ejected from said chute to said gun with said loading pendulum.

8. The method according to claim 7 wherein said conveying step is achieved by a moving conveyor belt fitted on cog wheels fixed at each end of said feeding magazine, said plurality of chutes being disposed along said conveyor belt.

9. The method according to claim 7 further comprising the steps of opening a vertical side of said feed magazine and inserting charge modules into empty chutes through said vertical side.

10. The method according to claim 7 wherein in said conveying step an identical number of charge modules is always conveyed to the feed opening and the charge modules not used in a charge preparation are conveyed back to the feed magazine at the same time as another chute of charge modules is conveyed to the feed opening.

* * * * *